US012409495B2

(12) United States Patent
Kool et al.

(10) Patent No.: US 12,409,495 B2
(45) Date of Patent: Sep. 9, 2025

(54) ALUMINUM SLURRY COATINGS AND METHODS OF THEIR FORMATION AND USE

(71) Applicant: General Electric Company, Schenectady, NY (US)

(72) Inventors: Lawrence Bernard Kool, Clifton Park, NY (US); Mark Alan Rhoads, Cincinnati, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/507,267

(22) Filed: Nov. 13, 2023

(65) Prior Publication Data

US 2024/0075527 A1 Mar. 7, 2024

Related U.S. Application Data

(63) Continuation of application No. 17/410,512, filed on Aug. 24, 2021, now Pat. No. 11,925,988.

(51) Int. Cl.
*B22F 9/18* (2006.01)
*B22F 1/145* (2022.01)

(52) U.S. Cl.
CPC ..... *B22F 9/18* (2013.01); *B22F 1/145* (2022.01); *B22F 1/147* (2022.01); *B22F 2301/052* (2013.01); *B22F 2302/25* (2013.01)

(58) Field of Classification Search
CPC .... B22F 9/18; B22F 9/20; B22F 1/145; B22F 1/147; B22F 2301/052; B22F 2302/25;
(Continued)

(56) References Cited

U.S. PATENT DOCUMENTS 3,063,877 A 11/1962 Schiffman
4,544,408 A 10/1985 Mosser et al.
(Continued)

FOREIGN PATENT DOCUMENTS

CN 101840744 B 4/2012
CN 102851634 B 1/2015
(Continued)

OTHER PUBLICATIONS

Reigel et al. ("Reduction by Aluminum Powder in Aqueous solution" Analytical Chemistry 24.11 (1952): 1803-1806) (Year: 1952).*
(Continued)

*Primary Examiner* — Ricardo D Morales
(74) *Attorney, Agent, or Firm* — Dority & Manning, P.A.

(57) ABSTRACT

Methods for reducing a concentration of hexavalent chromium within a first aluminum slurry by adding a reducing agent to form a second aluminum slurry are provided. The reducing agent causes a chemical reduction reaction with the hexavalent chromium compound of the first aluminum slurry to form a trivalent chromium compound within the second aluminum slurry such that a first weight ratio of hexavalent chromium to trivalent chromium in the first aluminum slurry is decreased to a second weight ratio of hexavalent chromium to trivalent chromium in the second aluminum slurry, with the second weight ratio being less than the first weight ratio.

18 Claims, 2 Drawing Sheets

(58) Field of Classification Search
CPC ..... C23C 22/05; C23C 22/06; C23C 22/07; C23C 22/08; C23C 22/24; C23C 22/26; C23C 22/27; C23C 22/30; C23C 22/32; C23C 22/33; C23C 22/36; C23C 22/37; C23C 22/38; C23C 22/72; C23C 22/74; C23F 11/00
See application file for complete search history.

(56) References Cited

U.S. PATENT DOCUMENTS

| | | | | |
|---|---|---|---|---|
| 5,803,990 | A | 9/1998 | Mosser et al. | |
| 6,224,657 | B1 * | 5/2001 | Myers | C04B 28/34 427/376.6 |
| 6,361,622 | B1 * | 3/2002 | McCormick | C23C 22/36 106/14.44 |
| 7,449,241 | B2 | 11/2008 | Gigliotti, Jr. et al. | |
| 2005/0031781 | A1 | 2/2005 | Kool et al. | |
| 2009/0246389 | A1 | 10/2009 | Mosser et al. | |
| 2018/0334925 | A1 | 11/2018 | Hanlon et al. | |

FOREIGN PATENT DOCUMENTS

| | | | |
|---|---|---|---|
| CN | 104805430 | A | 7/2015 |
| CN | 103480981 | B | 4/2016 |
| CN | 107353034 | A | 11/2017 |
| CN | 108384961 | B | 12/2019 |
| EP | 3406759 | A1 | 11/2018 |

OTHER PUBLICATIONS

Dybko et al., Application of Optical Fibres in Oxidation-Reduction Titrations, Sensors and Actuators B: Chemical, vol. 29, Issues 1-3, 1995, 374-377. https://doi.org/10. 1016/0925-4005(95)01710-0.
Reigel et al., Reduction by Aluminum Powder in Aqueous Solution, Analytical Chemistry, vol. 24, No. 11, 1952, 1803-1806. https://pubs.acs.org/doi/abs/10.1021/ac60071a025.

* cited by examiner

ALUMINUM SLURRY COATINGS AND METHODS OF THEIR FORMATION AND USE

PRIORITY INFORMATION

The present application claims priority to, and is a continuation of, U.S. patent application Ser. No. 17/410,512 filed on Aug. 24, 2021, which is incorporated by reference herein in its entirety for all purposes.

FIELD OF TECHNOLOGY

The present disclosure relates generally to coatings for substrates. More particularly, the present disclosure is directed to methods and coatings for inhibiting corrosion of high temperature components, such as gas turbine components.

BACKGROUND

Turbine engines, especially aviation gas turbine engines, have been increasingly moving towards higher power and higher performance designs. As a result, many turbine components are subjected to severe stresses at times. For critical rotating components and engine mounts in such gas turbine engines, ferrous materials of excellent toughness are often preferred. In particular, high strength steels, typified by maraging steels, are often used for such components. Maraging steels are generally nickel-containing iron-base alloys of extremely high strength, typically produced from martensite steel by spontaneous hardening at moderate temperatures without quenching. Such high strength steels are often used in applications in which structural components are subjected to torsional fatigue, such as fan shafts that couple a turbine to a fan of a turbine engine.

In order to protect these high strength steels, coatings have been developed to help inhibit environmental attack. Overlay coatings conferring a sacrificial galvanic property to turbine components have been preferred. One popular type of coating employs water-based slurries containing an aluminum-based dispersion in an acidic solution containing anions such as phosphates and chromates. Upon exposure to heat and curing, these slurries can transform to an insoluble electrically conductive metal/ceramic composite.

However, a portion of the chromates within such aluminum slurries may be in the form of hexavalent chromium ("Cr(VI)"). Although the hexavalent chromium changes valence once the slurry is applied and formed into a coating, hexavalent chromium is being phased out globally to meet environmental requirements.

As such, a need exists for an improved aluminum slurry having a reduced hexavalent chromium concentration without impacting the resulting coatings formed therefrom.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
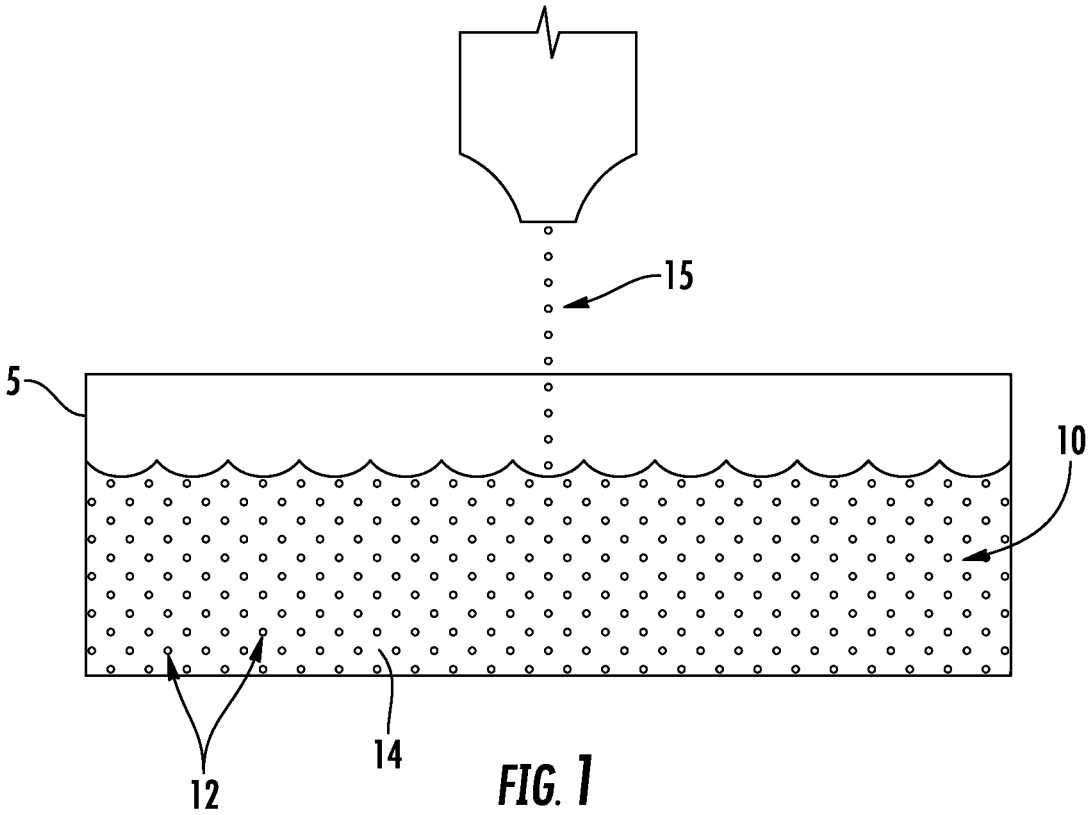
FIG. 1 shows an exemplary process of adding aluminum powder to an aluminum slurry according to one embodiment.

Repeat use of reference characters in the present specification and drawings is intended to represent the same or analogous features or elements of the present invention.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "aluminum slurry" generally refers to a solid-particle suspension of an aluminum powder in liquid. Selection of the liquid carrier depends on various factors, such as: the solubility of the aluminum particles of the aluminum powder and other optional additives; the evaporation rate required during subsequent processing; the effect of the carrier on the adhesion of the slurry coating to a substrate; the carrier's ability to wet the substrate to modify the rheology of the slurry composition; as well as handling requirements; cost; availability; and environmental/safety concerns. Non-limiting examples of carriers include water; alcohols such as ethanol and isopropanol; terpene and terpene-derivatives such as terpineol; halogenated hydrocarbon solvents such as methylene chloride and tetrachloromethane; and compatible mixtures of any of these substances. The amount of liquid carrier employed may be selected to be a minimum amount sufficient to keep the solid components of the slurry in suspension. Amounts greater than this minimum level may be used to adjust the viscosity of the slurry composition, depending on the technique used to apply the composition to a substrate. In general, the liquid carrier will comprise about 30% by volume to about 70% by volume of the entire slurry composition. Additional amounts of the liquid carrier may be used to adjust slurry viscosity prior to application of the coating.

Methods are generally provided for the formation and use of an improved aluminum slurry for forming a coating on a substrate. For example, the improved aluminum slurry may have a reduced concentration of hexavalent chromium, such as to a concentration of 0.1% by weight or less.

The concentration of hexavalent chromium may be lowered through a reduction reaction within the slurry, so as to convert the hexavalent chromium to trivalent chromium. Trivalent chromium is much less toxic than hexavalent chromium. In one embodiment, a reducing agent is added to the slurry to convert Cr(VI) in the slurry to Cr(III). Thus, a slurry may be formed without any significant concentration of hexavalent chromium, without changing the effectiveness of the resulting coating such that the coating functions as well or better than the legacy slurry coatings.

Generally, methods are provided for reducing a concentration of hexavalent chromium within a first aluminum slurry (i.e., an initial aluminum slurry) to form a second aluminum slurry. The first aluminum slurry generally contains a first aluminum powder, a phosphoric acid, a hexavalent chromium compound, and a solvent (e.g., water). The chromium generally serves to protect the aluminum powder from being reacted with and/or dissolved into the phosphoric acid. Referring to FIG. 1, for example, a first aluminum slurry 10 is shown having a first aluminum powder 12 dispersed within a solution 14 (e.g., including phosphoric acid, a hexavalent chromium compound, and a solvent such as water) and positioned within a container 5.

For example, the hexavalent chromium compound within the first aluminum slurry may be chromium oxide (e.g., $CrO_3$). In certain embodiments, the first aluminum slurry may also include a trivalent chromium compound. The trivalent chromium compound may be chromium (III) hydroxide. When present in the first aluminum slurry, the trivalent chromium compound is present at a concentration that is less than the hexavalent chromium compound (e.g., at a weight ratio of the hexavalent chromium compound to the trivalent chromium compound that is greater than 1, such as 1 to 10). As such, the hexavalent chromium compound and trivalent chromium are present in the first aluminum slurry in a first weight ratio of hexavalent chromium to trivalent chromium, which is decreased to a second weight ratio of hexavalent chromium to trivalent chromium in the second aluminum slurry that is less than the first weight ratio.

To reduce the concentration of hexavalent chromium within the first aluminum slurry, a reducing agent is added to the first aluminum slurry to cause a chemical reduction reaction with hexavalent chromium to form trivalent chromium. For example, referring to FIG. 1, a reducing agent 15 is shown being added to the first aluminum slurry 10. Due to the addition of the reducing agent to the first aluminum slurry and the resulting chemical reduction reaction, a weight ratio of hexavalent chromium to trivalent chromium is decreased (e.g., from a first weight ratio to a second weight ratio that is less than the first weight ratio). In one embodiment, the first slurry ratio is 5 or greater (e.g., 5 to 10). No matter the first slurry ratio in a particular slurry, the second slurry ratio is less than the first slurry ratio. For example, the second slurry ratio may be 5 or less, such as 3 or less (e.g., 0.001 to 3, such as 0.001 to 2).

In one embodiment, the reducing agent includes aluminum, iron, zinc, or a mixture thereof. For example, the reducing agent may be in powder form, such as an aluminum powder, an iron powder, a zinc powder, or a mixture thereof. In particular embodiments, the reducing agent includes a powder of a substantially pure metal of aluminum, iron, or zinc such that the substantially pure metal includes only the aluminum, iron, or zinc and any unavoidable impurities therein (i.e., less than 1% by weight impurities). As used herein, the term "unavoidable impurities" refers to materials that are unintentionally present due to the imperfect nature of metallurgy processing and other realities. When the reducing agent includes an aluminum powder, it may be referred to herein as a second aluminum powder to distinguish from the first aluminum powder of the first aluminum slurry. That is, the second aluminum powder may have the same or different characteristics and properties as the first aluminum powder.

In particular embodiments, the reducing agent may be added in an amount sufficient to reduce the hexavalent chromium present in the first aluminum slurry to trivalent chromium. For example, the amount of hexavalent chromium present in the first aluminum slurry may be determined prior to adding the second aluminum powder. Then, the reducing agent may be added in an amount based on the determined amount of hexavalent chromium present in the first aluminum slurry. For example, the amount of reducing agent to be added may be determined experimentally by adding successive small amounts of aluminum powder to a slurry of known volume and concentration and measuring the decrease in concentration of Cr(VI) in the resultant slurries using standard analytical chemical methods. Then, the molar quantity of added aluminum may be plotted vs. the concentration of Cr(VI) to produce a linear plot that can be used to predict the amount of aluminum need to reduce the concentration of Cr(VI) to the desired target.

In particular embodiments, the reducing agent may be titrated into the first aluminum slurry based on the determined amount of hexavalent chromium present in the first aluminum slurry. Alternatively, the reducing agent may be added to the first aluminum slurry until a response indicator signals that the amount of hexavalent chromium is decreased to the second slurry ratio. For instance, the response indicator may be a color change from a first color of the first aluminum slurry to a second color of the second aluminum slurry that is different than the first color.

For example, the reducing agent (e.g., second aluminum powder) may be added in an amount of 100% to 115% required to reduce the determined amount of hexavalent chromium present in the first aluminum slurry to trivalent chromium. As such, the reducing agent may substantially reduce all of the hexavalent chromium present in the first aluminum slurry while minimizing the increase in the relative concentration of aluminum to phosphoric acid.

In one embodiment, the first aluminum slurry may include (prior to the addition of the reducing agent) the first aluminum powder, the acidic phosphate, 1% by weight to 5% by weight hexavalent chromium, 0.1% by weight to 1% by weight trivalent chromium, and water.

The first aluminum powder is generally a plurality of metal aluminum particles having a desired particle size and distribution for the coating process. For example, the particles may have an average diameter of 25 microns or less, such as 10 microns or less. In particular embodiments, the first aluminum slurry may include 20% by weight to 50% by weight of the first aluminum powder, such as 25% by weight to 50% by weight. By way of further example, the first aluminum slurry may include at least 20%, at least 22%, at least 24%, at least 26%, at least 28% or at least 30% by weight, and less than or equal to 50%, 48%, 46%, 44%, 42%, or 40% by weight of the first aluminum powder.

The phosphoric acid generally stabilizes the aluminum powder in the slurry. For example, the phosphoric acid generally serves to inhibit oxidation of the aluminum powder while in the slurry. In certain embodiments, the first aluminum slurry may include 10% by weight to 30% by weight of the phosphoric acid, such as 10% by weight to 25% by weight. By way of further example, the first aluminum slurry may include at least 10%, at least 12%, at least 14% or at least 16%, and less than or equal to 30%, 28%, 26%, 24% or 22% by weight of the phosphoric acid.

In particular embodiments, the first aluminum slurry may be a commercially available slurry, such as SermeTel W (Sermatech International Inc., Royersford, PA), IpCote Sacrificial Aluminum IP 9183-R1 (Indestructible Paint Co. Ltd., Birmingham, United Kingdom), or Alseal 519 (Coatings for Industry, Inc, Souderton, PA).

The reducing agent may be added to the first aluminum slurry as an unoxidized powder or as an oxidized powder. When in an unoxidized state, the reducing agent powder is generally more reactive for efficient reduction of the hexavalent chromium via the chemical reduction reaction, than compared to the oxidized powder. The first aluminum slurry may be heated to a reaction temperature, in particular embodiments, to facilitate the chemical reduction reaction to convert hexavalent chromium to trivalent chromium. For instance, when heated, the reaction temperature may be 25° C. to 100° C.

When the reducing agent is a second aluminum powder, the second aluminum powder added to the first aluminum slurry may increase the total aluminum concentration in the first aluminum slurry by 1% to 20% (e.g., by 5% to 15%) from a first aluminum concentration to a second aluminum concentration in the resulting second aluminum slurry.

In one particular embodiment, the second aluminum powder may be added to the first aluminum slurry as an unoxidized aluminum powder or as an oxidized aluminum powder. When in an unoxidized state, the aluminum powder is generally more reactive for efficient reduction of the hexavalent chromium via the chemical reduction reaction, than compared to the oxidized aluminum powder. The first aluminum slurry may be heated to a reaction temperature, in particular embodiments, to facilitate the chemical reduction reaction to convert hexavalent chromium to trivalent chromium. For instance, when heated, the reaction temperature may be 25° C. to 100° C.

After the addition of the reducing agent (e.g., second aluminum powder) and resulting chemical reduction reaction, the second aluminum slurry may include, in certain embodiments, the first aluminum powder, the reducing agent (e.g., the second aluminum powder), the acidic phosphate, less than 0.1% by weight hexavalent chromium (e.g., less than 0.01% by weight hexavalent chromium), 0.5% by weight to 3% by weight trivalent chromium, and water.

Figure 2:
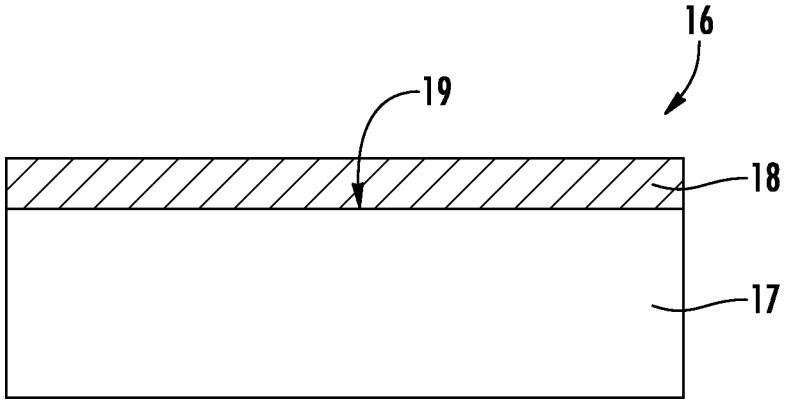
FIG. 2 shows an exemplary coated substrate formed using an aluminum slurry according to one embodiment.

As stated, the second aluminum slurry (after adding the reducing agent to reduce the concentration of hexavalent chromium) may be applied to a surface of a substrate to form a coating thereon. In one embodiment, the coating formed from the second aluminum slurry includes an aluminum phase dispersed within a matrix phase of chromium-phosphate-aluminum. Referring to FIG. 2 for example, a coated component 16 is shown including a substrate 17 having a coating 18 on its surface 19. In the present disclosure, when a coating is being described as "on" or "over" another layer or substrate, it is to be understood that the coating can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

The second aluminum slurry may be deposited on a substrate by various techniques, such as spraying. In particular embodiments, the slurry may be applied in multiple applications, with heat treatments between each application to remove the volatile components. The resulting coating may then be subjected to a diffusion heat treatment as desired to form an aluminide coating, such as using platinum for diffusion therein to form a platinum-aluminide coating.

The substrate may be a superalloy (e.g., a nickel-based superalloy, a cobalt-based superalloy, etc.), or other alloy material suitable for use in a turbine engine.

Figure 3:
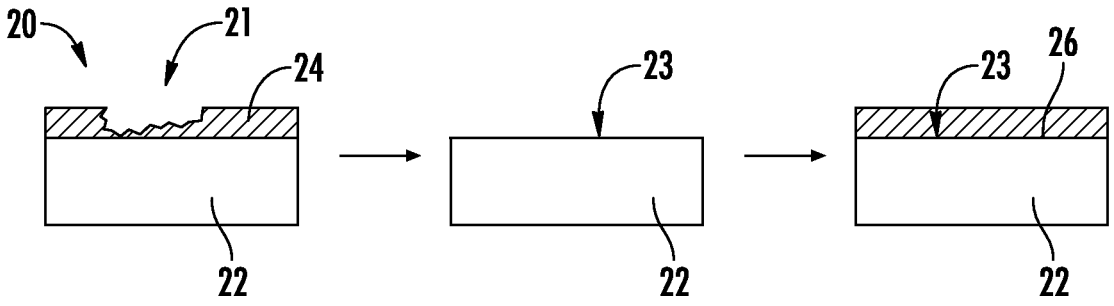
FIG. 3 shows an exemplary process for repairing a coating of a substrate using an aluminum slurry according to one embodiment.

The presently described slurries may also be suitable for use in repair methods for addressing damaged or worn aluminide coatings applied over a substrate. For example, FIG. 3 depicts an exemplary damaged component 20 that includes a substrate 22 with a damaged coating 24 with a damaged area 21 therein. The damaged coating 24 may be removed from the substrate 22 (either in a selected area or from the entire surface 23 of the substrate). Then, the second aluminum slurry may be applied onto the exposed surface 23 to form a replacement coating 26 via depositing the second aluminum slurry on the selected area (in place of the removed coating). Then, the slurry may be treated under temperature and time conditions sufficient to remove substantially all volatile material from the deposited slurry to form a coating on the selected area.

Further aspects of the invention are provided by the subject matter of the following clauses:

1. A method of reducing a concentration of hexavalent chromium within a first aluminum slurry containing a first aluminum powder, a phosphoric acid, a hexavalent chromium compound, and water, the method comprising: adding a reducing agent to the first aluminum slurry to form a second aluminum slurry, wherein the reducing agent causes a chemical reduction reaction with the hexavalent chromium compound to form a trivalent chromium compound within the second aluminum slurry such that a first weight ratio of hexavalent chromium to trivalent chromium in the first aluminum slurry is decreased to a second weight ratio of hexavalent chromium to trivalent chromium in the second aluminum slurry, with the second weight ratio being less than the first weight ratio.
2. The method of any preceding clause, further comprising: prior to adding the reducing agent, determining an amount of hexavalent chromium present in the first aluminum slurry, wherein the reducing agent is added in an amount based on the determined amount of hexavalent chromium present in the first aluminum slurry.
3. The method of any preceding clause, wherein the reducing agent is added in an amount of 100% to 115% to reduce the determined amount of hexavalent chromium present in the first aluminum slurry to trivalent chromium.
4. The method of any preceding clause, wherein adding the reducing agent to the first aluminum slurry comprises: titrating the reducing agent based on the determined amount of hexavalent chromium present in the first aluminum slurry.
5. The method of any preceding clause, wherein the reducing agent is added in an amount sufficient to reduce the hexavalent chromium concentration to a concentration of 0.1% by weight or less within the second aluminum slurry.
6. The method of any preceding clause, wherein the reducing agent is added in an amount sufficient to reduce the hexavalent chromium concentration to a concentration of 0.01% by weight or less within the second aluminum slurry.
7. The method of any preceding clause, wherein adding the reducing agent to the first aluminum slurry comprises: titrating the reducing agent until a response indicator signals that the amount of hexavalent chromium is decreased to the second weight ratio.
8. The method of any preceding clause, wherein the response indicator is a color change from a first color of the first aluminum slurry to a second color of the second aluminum slurry that is different than the first color.
9. The method of any preceding clause, wherein the first aluminum slurry, prior to the addition of the reducing agent, comprises: the first aluminum powder, the phosphoric acid, 1% by weight to 5% by weight hexavalent chromium, 0.1% by weight to 1% by weight trivalent chromium, and water.

10. The method of any preceding clause, wherein the reducing agent comprises aluminum, iron, zinc, or a mixture thereof.
11. The method of any preceding clause, wherein the reducing agent comprises a second aluminum powder.
12. The method of any preceding clause, wherein adding the second aluminum powder to the first aluminum slurry increases a total aluminum concentration in the first aluminum slurry by 1% to 20% from a first aluminum concentration.
13. The method of any preceding clause, wherein the second aluminum slurry, after the addition of the second aluminum powder and resulting chemical reduction reaction, comprises: the first aluminum powder, the second aluminum powder, the acidic phosphate, less than 0.1% by weight hexavalent chromium, 0.5% by weight to 3% by weight trivalent chromium, and water.
14. The method of any preceding clause, wherein the second aluminum powder added to the first aluminum slurry is an unoxidized aluminum powder.
15. The method of any preceding clause, wherein the second aluminum powder added to the first aluminum slurry is an oxidized aluminum powder.
16. The method of any preceding clause, further comprising: heating the first aluminum slurry to facilitate the chemical reduction reaction.
17. The method of any preceding clause, wherein the first weight ratio is 5 or greater, and wherein the second weight ratio is 5 or less.
18. The method of any preceding clause, wherein the second weight ratio is 3 or less.
19. The method of any preceding clause, further comprising: after adding the reducing agent, applying the second aluminum slurry to a surface of a substrate to form a coating thereon.
20. A slurry made according to the method of any preceding clause.
21. A slurry, comprising: an aluminum powder; an acidic phosphate; a chromium oxide, wherein the chromium oxide comprises hexavalent chromium and trivalent chromium at a weight ratio of 5 or less; and water.
22. A method of applying a slurry onto a surface of a substrate.
23. A method of repairing a damaged coating, the method comprising: removing the damaged coating from the surface of the substrate, and thereafter, applying the slurry of any preceding clause onto the surface of the substrate.

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A slurry, comprising:
an aluminum powder;
an acidic phosphate;
a chromium oxide, wherein the chromium oxide comprises hexavalent chromium and trivalent chromium at a weight ratio of hexavalent chromium to trivalent chromium of 0.001 to 3; and
water.

2. The slurry of claim 1, wherein the weight ratio of hexavalent chromium to trivalent chromium is 0.001 to 2.

3. The slurry of claim 1, further comprising:
a reducing agent.

4. The slurry of claim 3, wherein the reducing agent comprises a second aluminum powder, an iron powder, a zinc powder, or a mixture thereof.

5. The slurry of claim 3, wherein the reducing agent comprises a powder of a substantially pure metal of aluminum, iron, or zinc.

6. The slurry of claim 1, wherein the hexavalent chromium comprises less than 0.1% of the slurry.

7. The slurry of claim 1, wherein the trivalent chromium comprises 0.5% by weight to 3% of the slurry.

8. The slurry of claim 1, further comprising a second aluminum powder.

9. The slurry of claim 8, wherein the second aluminum powder comprises an unoxidized aluminum powder.

10. The slurry of claim 8, wherein the second aluminum powder comprises an oxidized aluminum powder.

11. The slurry of claim 1, wherein the hexavalent chromium is less than 0.1% by weight of the slurry and the trivalent chromium is 0.5% by weight to 3% by weight of the slurry.

12. A method of repairing a damaged coating, the method comprising:
removing a damaged coating from a surface of the substrate; and
thereafter, applying the slurry of claim 1 onto the surface of the substrate.

13. A slurry, comprising:
a first aluminum powder;
a second aluminum powder;
an acidic phosphate;
less than 0.1% by weight hexavalent chromium;
0.5% by weight to 3% by weight trivalent chromium,
wherein the weight ratio of hexavalent chromium to trivalent chromium is 0.001 to 3; and
water.

14. The slurry of claim 13, wherein the hexavalent chromium comprises less than 0.01% by weight of the slurry.

15. The slurry of claim 13, wherein the second aluminum powder comprises an unoxidized aluminum powder.

16. The slurry of claim 13, wherein the second aluminum powder comprises an oxidized aluminum powder.

17. The slurry of claim 13, consisting essentially of:
a first aluminum powder;
a second aluminum powder;
an acidic phosphate;
less than 0.1% by weight hexavalent chromium;
0.5% by weight to 3% by weight trivalent chromium; and
water.

18. The slurry of claim 13, consisting essentially of:
a first aluminum powder;
a second aluminum powder;
an acidic phosphate;
less than 0.01% by weight hexavalent chromium;
0.5% by weight to 3% by weight trivalent chromium; and
water.

* * * * *